US006312113B1

(12) United States Patent
Murad

(10) Patent No.: US 6,312,113 B1
(45) Date of Patent: Nov. 6, 2001

(54) INK CIRCULATION SYSTEM

(75) Inventor: George Murad, Bartlett, IL (US)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/429,607

(22) Filed: Oct. 29, 1999

(51) Int. Cl.[7] ..... B41J 2/17
(52) U.S. Cl. ..... 347/84
(58) Field of Search ..... 347/89, 84, 85, 347/86, 87, 7, 77, 78

(56) References Cited

U.S. PATENT DOCUMENTS

| | | | | |
|---|---|---|---|---|
| 3,060,429 | | 10/1962 | Winston | 346/11 |
| 3,298,030 | | 1/1967 | Lewis et al. | 347/74 |
| 3,373,437 | | 3/1968 | Sweet et al. | 347/74 |
| 3,416,153 | | 12/1968 | Hertz et al. | 347/73 |
| 3,673,601 | | 6/1972 | Hertz | 347/73 |
| 4,973,980 | | 11/1990 | Howkins et al. | 347/70 |
| 5,036,365 | * | 7/1991 | Landa | 355/256 |
| 5,286,288 | | 2/1994 | Tobias et al. | 106/31.29 |
| 5,623,715 | | 4/1997 | Clark | 399/57 |
| 5,798,781 | | 8/1998 | Pedersen et al. | 347/89 |
| 6,036,296 | * | 3/2000 | Axtell et al. | 347/7 |

FOREIGN PATENT DOCUMENTS

| | | | |
|---|---|---|---|
| 0 736 388 | | 10/1996 | (EP) . |
| 803 362 | * | 10/1997 | (EP) . |
| 55-90368 | | 7/1980 | (JP) . |
| 60-201955 | | 10/1985 | (JP) . |
| 60-299763 | | 11/1985 | (JP) . |
| 62-39247 | | 2/1987 | (JP) . |
| 3-246053 | | 11/1991 | (JP) . |
| 4-261860 | | 9/1992 | (JP) . |
| 05185600 | | 7/1993 | (JP) . |
| 6-33300 | | 2/1994 | (JP) . |
| 7-205450 | | 8/1995 | (JP) . |
| 9-300649 | | 11/1997 | (JP) . |
| 10-52923 | | 2/1998 | (JP) . |
| 11245429-A | | 9/1999 | (JP) . |

OTHER PUBLICATIONS

"Apparatus for Physical Dispersion of Pigment Ink for Ink Jet Printing", Research Disclosure—May 1995/319, Disclosed by Young Soo You and an abstract (2 pages).
M.R. Keeling, "Ink Jet Printing", Phys. Technol., vol. 12, 1981, pp. 196–203.
Kuhn et al., "Ink Jet Printing", Scientific American, 4/79, pp. 162–178.
EXCEL P Service Manual, Figure 6–31, Component Identification for Calibrating the Ink Add Time Procedure, 6–41, 1995.
EXCEL P Service Manual, Figure 9–6, Generic EXCEL P Printer, Sheet 3 (continued), 9–9, 1995.
"Think Accutinter 600—For Cost Effective Small Batches", Brochure, Fluid Management L.P., Dec., 1993.

* cited by examiner

*Primary Examiner*—N. Le
*Assistant Examiner*—Michael Nghiem
(74) *Attorney, Agent, or Firm*—Leydig, Voit & Mayer, Ltd.

(57) ABSTRACT

A circulation system for mixing ink jet ink includes a container, a pump, and first and second tubes. The container has a bottom surface and a top portion opposing the bottom surface. The pump has an inlet port and an outlet port. The first tube has first and second ends. The first end of the first tube is connected to the inlet port of the pump, and the second end of the first tube includes a plurality of openings in close proximity to the bottom surface of the container. The second tube has first and second ends. The first end of the second tube is connected to the outlet port of the pump, and the second end of the second tube has an opening disposed in the top portion. A method for mixing ink jet ink includes circulating pigment particles from a bottom surface of a container to a top portion of the container. The circulation provides sufficient agitation to maintain the pigment particles suspended in the ink and to prevent agglomeration of pigment particles.

31 Claims, 1 Drawing Sheet

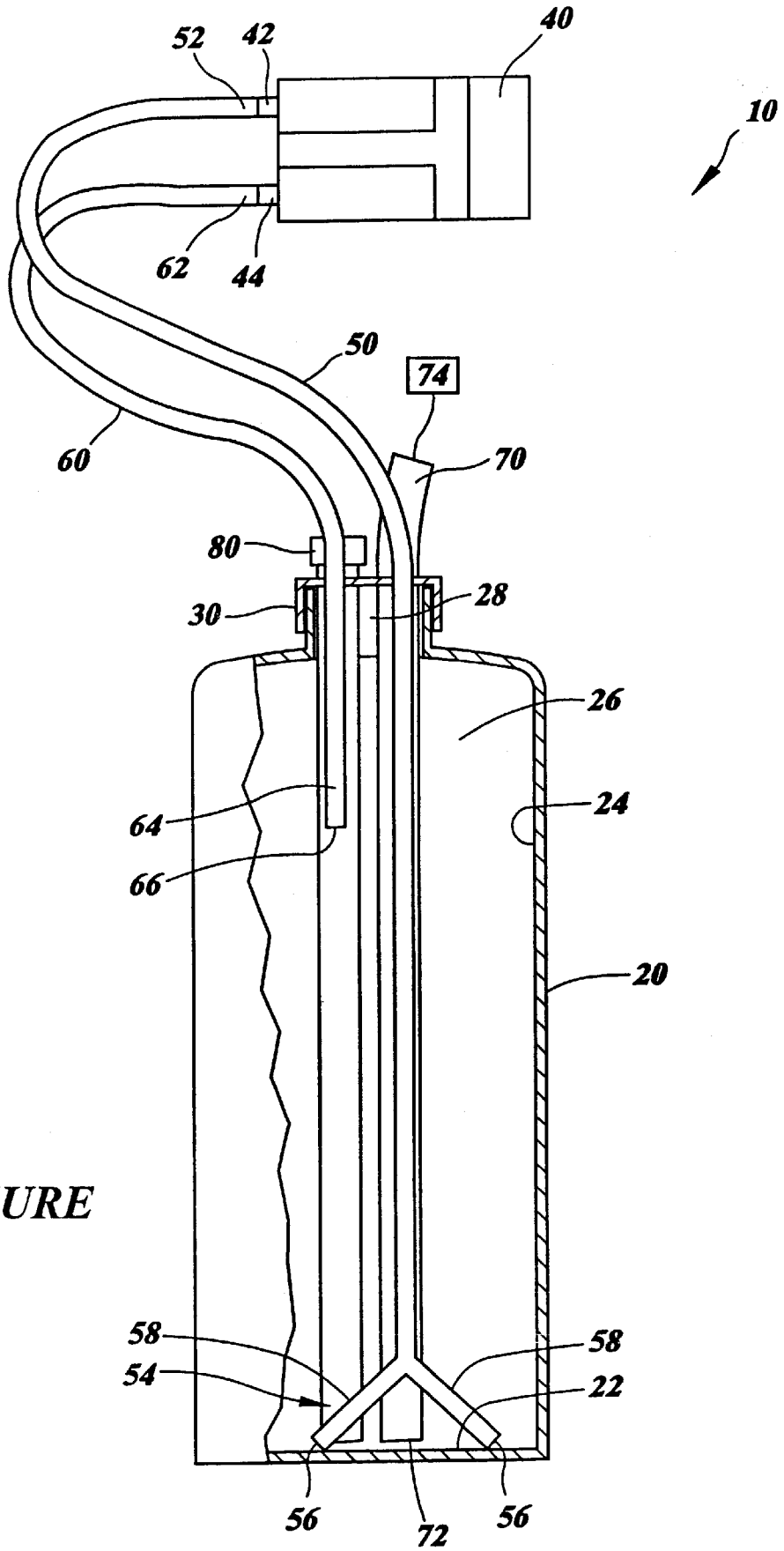
FIGURE

INK CIRCULATION SYSTEM

FIELD OF THE INVENTION

The present invention in general relates to a circulation system for mixing ink jet ink and in particular to a circulation system for mixing pigmented ink jet ink.

BACKGROUND OF THE INVENTION

Ink jet printing is a well-known technique by which printing is accomplished without contact between the printing device and the substrate on which the printed characters are deposited. Briefly described, ink jet printing involves the technique of projecting a stream of ink droplets to a surface and controlling the direction of the stream so that the droplets are caused to form the desired printed image on that surface. This technique of noncontact printing is well suited for application of characters onto a variety of surfaces including porous and non-porous surfaces.

Reviews of various aspects of ink jet printing can be found in these publications: Kuhn et al., Scientific American, April, 1979, 162–178; and Keeling, Phys. Technol., 12(5), 196–303 (1981). Various ink jet apparatuses are described in the following U.S. Pat. Nos. 3,060,429, 3,298,030, 3,373,437, 3,416,153, and 3,673,601.

Pigmented ink, which includes insoluble pigment particles, is frequently used in ink jet printing. Although it has a number of desirable characteristics, pigmented ink also has a significant drawback. The pigment particles tend to agglomerate and settle at the bottom surface of the ink supply container, causing nozzle clogging and disruption in printing, as well as a decrease in print contrast. The nozzles typically have a diameter around about 2.5 to 3.0 thousandths of an inch.

Attempts have been made to maintain pigment particles uniformly suspended in the ink jet ink. However, many of these attempts have not been successful or provide techniques having drawbacks. For example, one technique involves the use of a magnetic stirrer disposed in the ink container. The rod-shaped magnetic stirrer, usually disposed at the bottom of the container, is driven by a varying magnetic field generated by rotating magnets outside of the container.

Use of this technique in ink jet printing, however, is costly and complex. The system occupies a large volume of printer space. In addition, the system has a relatively short service life, because it involves moving mechanical parts causing significant mechanical wear. Further, it is time-consuming to extract the magnetic rod from a depleted ink container and deposit the magnetic rod in a full container every time a depleted ink container is replaced by a new ink container.

The foregoing indicates that there exists a need for a system that reduces or eliminates pigment settling. There further exists a need for an ink jet printing system that prints without nozzle clogging for extended periods of time.

These and other advantages of the present invention as well as additional inventive features will be apparent from the detailed description of the invention set forth herein below.

BRIEF SUMMARY OF THE INVENTION

Many of the foregoing needs have been fulfilled by the present invention which provides a circulation system for mixing ink and overcomes the drawbacks of the conventional techniques. The present invention utilizes the technique of circulation to maintain the pigment particles suspended in the ink and prevent agglomeration of pigment particles.

In accordance with one aspect of the invention, a circulation system for mixing ink jet ink includes a container, a pump, and first and second tubes. The container has a bottom surface and a top portion opposing the bottom surface. The pump has an inlet port and an outlet port. The first tube has first and second ends. The first end of the first tube is connected to the inlet port of the pump, and the second end of the first tube includes a plurality of openings in close proximity to the bottom surface of the container. The second tube has first and second ends. The first end of the second tube is connected to the outlet port of the pump, and the second end of the second tube has an opening disposed in the top portion.

In accordance with another aspect of the invention, a method for mixing ink jet ink includes drawing ink from a bottom surface of a container through a first tube having a plurality of openings in close proximity to the bottom surface of the container; and returning the ink drawn from the container to the container through a second tube having an opening disposed in a top portion of the container.

In accordance with a further aspect of the invention, a method for ink jet printing onto a substrate includes drawing ink from a bottom surface of a container through a first tube having a plurality of openings in close proximity to the bottom surface of the container, returning the ink, which is drawn from the container through the first tube, to the container through a second tube, drawing ink from the container through a third tube, directing a stream of ink droplets, formed from the ink from the third tube, to the substrate, and controlling the direction of the droplets to form a desired image.

The circulation system in accordance with embodiments of the present invention has a number of advantages over known devices. For example, a printer device incorporating the circulation system of the present invention is relatively simple to operate and inexpensive. Embodiments of printer devices can be of small size. In addition, the device involves a minimum number of moving mechanical parts, reducing mechanical wear and increasing its service life. Further, because the tube connected to the inlet port of the pump includes a number of openings disposed in close proximity to the bottom surface of the container, the device is effective in collecting pigment particles from substantially all portions of the bottom surface and return the particles to other portions of the container, thus resulting in pigment particles uniformly suspended in the container.

While the invention has been described and disclosed below in connection with certain embodiments and procedures, it is not intended to limit the invention to those specific embodiments. Rather it is intended to cover all such alternative embodiments and modifications as fall within the spirit and scope of the invention.

BRIEF DESCRIPTION OF THE DRAWING

The FIGURE is a partial cross sectional side view of a circulation system for mixing ink jet ink according to an embodiment of the present invention.

DETAILED DESCRIPTION OF PREFERRED EMBODIMENTS

The FIGURE illustrates an embodiment of a circulation system 10 for mixing ink jet ink according to the present invention. The circulation system 10 includes a container 20, a pump 40, and first and second tubes 50, 60 extending into the container 20. The first and second tubes 50, 60 are connected respectively to the inlet and outlet ports 42, 44 of the pump 40. The pump 40 is adapted to draw ink in the container 20 through the first tube 50 and return the ink to the container 20 through the second tube 60.

The container may have any suitable regular or irregular configuration. Although the container 20 shown in The FIGURE has a generally cylindrical configuration, it may have, for example, a parallelepipedal, conical or spherical configuration. The container includes a bottom surface, which is defined by the interior surface of the container, on which pigment particles tend to accumulate if sufficient mixing is not provided. The bottom surface is usually the interior surface of the lowest portion of the container. For example, if the container 20 shown in The FIGURE is installed upright, the bottom surface is the interior end wall 22 of the container 20. Alternatively, if the container 20 is installed sideways, a portion of the interior side wall 24 of the container 20 is the bottom surface.

The container also includes a top portion which is defined as the interior space of the container, which is opposite of the bottom surface. The term "top portion of the container" as used herein is the space above the ink surface and the space immediate below the ink surface. The term "immediate below" as used herein can be defined in many different ways, depending on, for example, the dimension of the container and/or the depth of ink in the container. Alternatively, the term "top portion of the container" can be defined as the interior container space other than the space in close proximity to the bottom surface of the container. The term "in close proximity" is defined below.

The container 20 includes an opening 28 and a cover 30 (or a plurality of openings and covers), through which ink can be withdrawn from or deposited into the container 20 through, for example, one or more tubes 50, 60 extending through the cover 30. The opening can be located anywhere on the container.

The pump can be any suitable device that can be used to circulate ink in the container. Examples of the pump include a piston-type pump, a vane pump and a gear pump. In general, the pump can be any device that generates a pressure difference between its inlet and outlet ports. The pump can be powered electrically, hydraulically, pneumatically or mechanically. The pump may be placed inside or outside the container 20 as shown in The FIGURE. In some embodiments, the pump may be wholly or partially submerged in the ink Each of the inlet and outlet ports 42, 44 of the pump 40 includes fittings so that it can be sealingly connected to a tube.

The second tube 60 can also be any flexible or rigid fluid conduit. The second tube 60 includes a first end 62 connected to the outlet port 44 of the pump 40 and a second end 64 preferably at or near the top portion 26 of the container 20. Generally, the second end 64 of the second tube 60 can be disposed at any location in the container 20. In a preferred embodiment, the second end 64 may not be disposed above the surface of the ink to prevent or reduce foaming of the ink. If the pump 40 is disposed outside the container 20, the second tube 60 may extend through an opening 28 of the container 20 (and a cover 30, if a cover 30 is placed over the opening 28). The first and second tubes may extend through the same opening or different openings of the container. The second end 64 of the second tube 60 includes one opening 66, as shown in The FIGURE. In a preferred embodiment, the second end 64 of the second tube 60 is positioned away from the bottom surface 22 of the ink container 20, as the uniformity of mixing through the entire container can be significantly reduced, e.g., at low ink circulation velocities, if the openings 56 and the second end 64 are in close proximity to the bottom surface. In certain embodiments, the second end 64 of the second tube 60 may include a plurality of openings and/or branches disposed in the top portion 26 of the container 20.

In addition to the first and second tubes 50, 60, one or more additional tubes may be provided. As shown in The FIGURE, for example, tubes 70, 80 are used to monitor the ink level in the container 20 and to supply ink jet ink to the printer, respectively.

The tube 70 is used to pump air into the ink, and the ink level in the container 20 is determined from the air pressure in the tube 70. The tube 70 has an opening 72 disposed in the container 20, for example, near the bottom surface 22 of the container 20, and the air exits the tube 70 through the opening 72. The air pressure in the tube 70 is equal to the ink pressure at the opening 72 of the tube 70, and the ink pressure at the opening 72 is proportional to the ink level in the container. Thus, as the ink level in the container decreases, the air pressure in the tube 70 also decreases. When the ink level falls below the opening 72 of the tube 70, the air pressure in the tube 70 becomes equal to the atmospheric pressure. Thus, the ink level in the container 20 can be monitored by a pressure transducer 74, which can be mounted on the tube 70 to sense the air pressure in the tube 70. When the air pressure in the tube 70 falls below a predetermined level, thereby indicating the ink in the container is depleted, the pump 40 of the circulation system 10 may be shut down, and the depleted container may be replaced by a new full container.

The operation of the circulation system 10 can be described while referring to The FIGURE. When a new container of ink jet ink is installed in the ink jet printer, the second ends 54, 64 of the first and second tubes 50, 60 are placed in the container 20. The first ends 52, 62 of the first and second tubes 50, 60 are connected respectively to the inlet and outlet ports 42, 44 of the pump 40. At least some of the openings 56 of the second end 54 of the first tube 50 are placed in close proximity to the bottom surface 22 of the container 20, and the opening 66 (or openings) of the second end 64 of the second tube 60 is placed in the top portion 26 of the container 20. When the ink jet printer is in operation, the pump 40 may be powered on to draw ink jet ink from the bottom surface 22 of the container 20 through the first tube 50 into the inlet port 42 of the pump 40, and to return ink drawn from the container 20 to the container 20 through a second tube 60. The circulation system 10 may be operated continuously or periodically, and the system 10 may be automatically operated or may be manually powered on when the printing quality begins to deteriorate.

The first tube 50 can be any flexible or rigid fluid conduit. The first tube 50 includes a first end 52 connected to the inlet port 42 of the pump 40 and a second end 54 submerged in the ink. If the pump 40 is disposed outside of the container 20, the first tube 50 may extend through an opening 28 of the container 20 (and a cover 30, if a cover 30 is placed over the opening 28). The second end 54 of the first tube 50 includes a plurality of openings 56, some or all of which are in close proximity to the bottom surface 22 of the container 20. In some embodiments, some or all of the openings are in contact with the bottom surface of the container. In some preferred embodiments, the openings of the second end are generally evenly distributed throughout the bottom surface of the container to ensure that the pigment particles at all portions of the bottom surface are drawn into the first tube. Each of the openings 56 of the first tube 50 may be oriented in any suitable direction. Preferably, each opening 56 is oriented in a direction such that the opening 56 is not closed by the bottom surface 22 of the container 20, for example.

The term "close proximity" can be defined in many different ways and can be affected by a number of factors. The amount of the pigment particles drawn into the openings 56 of the first tube 50 depends not only on the distance between the openings 56 and the bottom surface 22 of the container 20, but also on, for example, the velocity at which the ink is drawn into the openings 56. The velocity is a function of, for example, the pump pressure and the inner diameters of the first tube. In one embodiment, for example, the term "close proximity" can be defined as a distance less than about 30 mm, preferably less than about 10 mm, more preferably less than about 5 mm, and even more preferably less than about 2 mm. In some embodiments, the distance is less than about 0.5 mm.

The present invention further provides an ink jet printer that includes the circulation system described above. The printer can be of any type, such as a continuous ink jet printer or a drop-on-demand ink jet printer.

In accordance with the present invention, the circulation system can be used to keep inks containing any suitable pigment. Examples of pigments include titanium dioxide and carbon black. Additional examples of pigments can be found in U.S. Pat. No. 5,286,288.

The efficacy or the advantages of the circulation system of the present invention can be determined by methods known to those skilled in the art. For example, the uniformity of pigment dispersion in the ink container can be determined by taking samples of the inks at periodic height or time intervals and measuring the pigment concentration in the samples. Pigment concentration can be determined by methods known to those skilled in the art, for example, by light scattering. Alternatively, or in addition, the quality of the print can be monitored, for example, by measuring the reflectance of the printed images.

The circulation system of the prevent invention is superior to certain systems known in the art, e.g., those providing a suction tube which is not in close proximity to the bottom surface of the ink container or which contains a single opening as disclosed in U.S. Pat. No. 5,798,781.

The following example further illustrates the present invention, but, of course, should not be construed as in any way limiting its scope.

EXAMPLE

This Example illustrates an advantage of an embodiment of the present invention. The ink circulation system of the present invention was effective in maintaining the pigment suspended in the ink.

A white ink having a sedimentation rate of 10–20 mg/hour was employed to print images on black paper. The ink contained $TiO_2$ as the pigment and a mixture of MEK and methanol as the solvent. Prints were produced with and without the use of the ink circulation system of the present invention.

A new full ink supply container containing 950 ml of white ink was installed in an ink jet printer. The container was shaken well prior to installing on the printer to achieve even distribution of pigment particles in the container. The contrast of the images was measured on a Kidder Optical Character Tester Model No. 082. Without the ink circulation system installed, the image obtained when the ink level was at 950 ml showed a reflectance value of 28%. As the volume of the ink in the container dropped to 450 ml, the image obtained had a reflectance value of 11%, and at 150 ml volume, the image obtained had a reflectance value of 5%.

However, with the ink circulation system of the present invention installed in the ink jet printer, the images obtained had a reflectance of from 28% to 26% at all measured volume levels. The substantially uniform and high reflectance values of the images confirmed that the pigment particles were kept in suspension and that the pigment concentration in the ink was uniform.

The references cited herein, including patents and publications, are incorporated herein in their entireties by reference.

While this invention has been described with an emphasis upon certain embodiments, it will be obvious to those of ordinary skill in the art that variations of the embodiments may be used and that it is intended that the invention may be practiced otherwise than as specifically described herein. Accordingly, this invention includes all modifications encompassed within the spirit and scope of the invention as defined by the following claims.

What is claimed is:

1. A circulation system for mixing an ink jet ink, the system comprising:

a container having a bottom surface and a top portion opposing the bottom surface;

a pump having an inlet port and an outlet port;

a first tube having first and second ends, the first end of the first tube being connected to the inlet port of the pump, the second end of the first tube including a plurality of openings in close proximity to the bottom surface of the container; and a second tube having first and second ends, the first end of the second tube being connected to the outlet port of the pump, the second end of the second tube having an opening disposed in the top portion.

2. The circulation system of claim 1, wherein the second end of the first tube includes a plurality of branches, and each branch includes at least one of the openings of the second end of the first tube.

3. The circulation system of claim 2, wherein at least one opening of each branch contacts the bottom surface of the container.

4. The circulation system of claim 1, wherein the distance between the bottom surface of the container and any one of the openings of the second end of the first tube is less than about 30 mm.

5. The circulation system of claim 4, wherein the distance is less than about 5 mm.

6. The circulation system of claim 5, wherein the distance is less than about 0.5 mm.

7. The circulation system of claim 1, wherein the openings of the first tube are in contact with the bottom surface of the container.

8. The circulation system of claim 1 including another tube having an opening disposed in the container, whereby air can be pumped into the ink in the container through said another tube and the opening of said another tube.

9. The circulation system of claim 8 including a pressure transducer connected to an inner space of said another tube to monitor the pressure in said another tube.

10. An ink jet printer comprising the circulation system of claim 1.

11. A method for mixing ink jet ink, the method comprising:

drawing ink from a bottom surface of a container through a first tube having a plurality of openings in close proximity to the bottom surface of the container; and returning the ink drawn from the container to the container through a second tube having an opening disposed in a top portion of the container.

12. The method of claim 11, wherein the first tube has an end having a plurality of branches, each of which includes at least one of the openings of the first tube.

13. The method of claim 11, wherein a pump is used to draw the ink from the container and return the ink to the container.

14. The method of claim 13, wherein the pump is powered on periodically.

15. The method of claim 11, wherein said ink is a pigmented ink.

16. A method for ink jet printing onto a substrate, the method comprising:

providing the circulation system of claim 1;

directing a stream of ink droplets to the substrate; and controlling the direction of the droplets to form a desired image.

17. The method of claim 16, wherein the first tube has an end having a plurality of branches, each of which includes at least one of the openings of the first tube.

18. The method of claim 16, wherein a pump is used to draw the ink from the container and return the ink to the container.

19. The method of claim 18, wherein the pump is powered on periodically.

20. A method for ink jet printing onto a substrate, the method comprising:

drawing ink from a bottom surface of a container through a first tube having a plurality of openings in close proximity to the bottom surface of the container;

returning the ink, which is drawn from the container through the first tube, to the container through a second tube;

drawing ink from the container through a third tube;

directing a stream of ink droplets to the substrate; and controlling the direction of the droplets to form a desired image.

21. A circulation system for mixing an ink jet ink, the system comprising:

a container having a bottom surface and a top portion opposing the bottom surface;

a pump having an inlet port and an outlet port;

a first tube having first and second ends, the first end of the first tube being connected directly to the inlet port of the pump, the second end of the first tube including a plurality of openings in close proximity to the bottom surface of the container; and a second tube having first and second ends, the first end of the second tube being connected to the outlet port of the pump, the second end of the second tube having an opening disposed in the top portion.

22. A circulation system for mixing an ink jet ink, the system comprising:

a container having a bottom surface and a top portion opposing the bottom surface;

a pump having an inlet port and an outlet port;

a first tube having first and second ends, the first end of the first tube being connected to the inlet port of the pump, the second end of the first tube including a plurality of openings in close proximity to the bottom surface of the container;

a second tube having first and second ends, the first end of the second tube being connected to the outlet port of the pump, the second end of the second tube having an opening disposed in the top portion; and another tube having an opening disposed in the container, whereby ink can be drawn from the container through said another tube.

23. A circulation system for mixing an ink jet ink, the system comprising:

a container having a bottom surface and a top portion opposing the bottom surface;

a pump having an inlet port and an outlet port;

a first tube having first and second ends, the first end of the first tube being connected to the inlet port of the pump, the second end of the first tube including a plurality of openings in close proximity to the bottom surface of the container; and a second tube having first and second ends, the first end of the second tube being connected to the outlet port of the pump, the second end of the second tube having an opening disposed in the top portion, wherein the second end of the first tube includes a plurality of branches, each branch including at least one of the openings of the second end of the first tube.

24. The circulation system of claim 23, wherein at least one opening of each branch contacts the bottom surface of the container.

25. The circulation system of claim 23, wherein the distance between the bottom surface of the container and any one of the openings of the second end of the first tube is less than about 30 mm.

26. The circulation system of claim 25, wherein the distance is less than about 5 mm.

27. The circulation system of claim 26, wherein the distance is less than about 0.5 mm.

28. The circulation system of claim 23, wherein the openings of the first tube are in contact with the bottom surface of the container.

29. A method for mixing ink jet ink, the method comprising:

drawing ink from a bottom surface of a container through a first tube having a plurality of openings in close proximity to the bottom surface of the container; and returning the ink drawn from the container to the container through a second tube having an opening disposed in a top portion of the container, wherein the first tube has an end having a plurality of branches, each of which includes at least one of the openings of the first tube.

30. A method for ink jet printing onto a substrate, the method comprising:

providing a circulation system for mixing an ink jet ink, the system comprising a container having a bottom surface and a top portion opposing the bottom surface, a pump having an inlet port and an outlet port, a first tube having first and second ends, the first end of the first tube being connected to the inlet port of the pump, the second end of the first tube including a plurality of openings in close proximity to the bottom surface of the container, and a second tube having first and second ends, the first end of the second tube being connected to the outlet port of the pump, the second end of the second tube having an opening disposed in the top portion, wherein the first tube has an end having a plurality of branches, each of which includes at least one of the openings in the first tube;

directing a stream of ink droplets to the substrate; and controlling the direction of the droplets to form a desired image.

31. A circulation system for mixing an ink jet ink, the system comprising:

a container having a bottom surface and a top portion opposing the bottom surface;

a pump having an inlet port and an outlet port;

a first tube having first and second ends, the first end of the first tube being connected to the inlet port of the pump, the second end of the first tube including a plurality of openings in close proximity to the bottom surface of the container;

a second tube having first and second ends, the first end of the second tube being connected to the outlet port of the pump, the second end of the second tube having an opening disposed in the top portion; and another tube having an opening disposed in the container, whereby air can be pumped into the ink in the container through said another tube.

* * * * *

UNITED STATES PATENT AND TRADEMARK OFFICE

CERTIFICATE OF CORRECTION

PATENT NO. : 6,312,113 B1
DATED : November 6, 2001
INVENTOR(S) : George Murad

It is certified that error appears in the above-identified patent and that said Letters Patent is hereby corrected as shown below:

Column 3,
Line 46, change "ink Each" to -- ink. Each --.
Line 48, insert the following paragraphs
-- The first tube 50 can be any flexible or rigid fluid conduit. The first tube 50 includes a first end 52 connected to the inlet port 42 of the pump 40 and a second end 54 submerged in the ink. If the pump 40 is disposed outside of the container 20, the first tube 50 may extend through an opening 28 of the container 20 (and a cover 30, if a cover 30 is placed over the opening 28). The second end 54 of the first tube 50 includes a plurality of openings 56, some or all of which are in close proximity to the bottom surface 22 of the container 20. In some embodiments, some or all of the openings are in contact with the bottom surface of the container. In some preferred embodiments, the openings of the second end are generally evenly distributed throughout the bottom surface of the container to ensure that the pigment particles at all portions of the bottom surface are drawn into the first tube. Each of the openings 56 of the first tube 50 may be oriented in any suitable direction. Preferably, each opening 56 is oriented in a direction such that the opening 56 is not closed by the bottom surface 22 of the container 20, for example.

The term "close proximity" can be defined in many different ways and can be affected by a number of factors. The amount of the pigment particles drawn into the openings 56 of the first tube 50 depends not only on the distance between the openings 56 and the bottom surface 22 of the container 20, but also on, for example, the velocity at which the ink is drawn into the openings 56. The velocity is a function of, for example, the pump pressure and the inner diameters of the first tube. In one embodiment, for example, the term "close proximity" can be defined as a distance less than about 30 mm, preferably less than about 10 mm, more preferably less than about 5 mm, and even more preferably less than about 2 mm. In some embodiments, the distance is less than about 0.5 mm.

UNITED STATES PATENT AND TRADEMARK OFFICE

CERTIFICATE OF CORRECTION

PATENT NO. : 6,312,113 B1
DATED : November 6, 2001
INVENTOR(S) : George Murad

It is certified that error appears in the above-identified patent and that said Letters Patent is hereby corrected as shown below:

The second end 54 of the first tube 50 may also include a plurality of branches 58, each of which includes at least one of the openings 56 of the second end 54 of the first tube 50. In the embodiment shown in The Figure, the second end 54 of the first tube 50 includes a plurality of laterally extending branches 58, each of which includes an opening 56 at its end. --

Column 4,
Delete the paragraphs beginning at line 51 through Column 5, line 16.

Signed and Sealed this

Thirteenth Day of August, 2002

*Attest:*

*Attesting Officer*

JAMES E. ROGAN
*Director of the United States Patent and Trademark Office*